US009676528B2

(12) United States Patent
Hui et al.

(10) Patent No.: US 9,676,528 B2
(45) Date of Patent: Jun. 13, 2017

(54) ENCASED DISPENSER

(71) Applicant: Beauty Union Global Limited, Chai Wan (HK)

(72) Inventors: Yi Ming Hui, Guangdong (CN); Zhi Wang, Guangdong (CN)

(73) Assignee: BEAUTY UNION GLOBAL LIMITED, Chai Wan (HK)

( * ) Notice: Subject to any disclaimer, the term of this patent is extended or adjusted under 35 U.S.C. 154(b) by 104 days.

(21) Appl. No.: 14/767,729

(22) PCT Filed: Nov. 7, 2013

(86) PCT No.: PCT/IB2013/002480

§ 371 (c)(1),
(2) Date: Aug. 13, 2015

(87) PCT Pub. No.: WO2014/072797

PCT Pub. Date: May 15, 2014

(65) Prior Publication Data

US 2016/0039582 A1 Feb. 11, 2016

Related U.S. Application Data

(60) Provisional application No. 61/814,377, filed on Apr. 22, 2013.

(30) Foreign Application Priority Data

Nov. 8, 2012 (CN) ..... 2012 2 0585452 U

(51) Int. Cl.
*B65D 47/04* (2006.01)
*A45D 34/00* (2006.01)
(Continued)

(52) U.S. Cl.
CPC ..... *B65D 47/04* (2013.01); *A45D 34/00* (2013.01); *A45D 34/02* (2013.01); *A45D 34/04* (2013.01);
(Continued)

(58) Field of Classification Search
CPC ..... B65D 47/04; A45D 34/04; A45D 40/26; A45D 34/00; A45D 34/02; A45D 2040/0012; A45D 2034/007
(Continued)

(56) References Cited

U.S. PATENT DOCUMENTS 3,718,165 A * 2/1973 Grothoff ..... B65B 3/04 137/583
3,844,450 A * 10/1974 Johnson ..... A47J 41/0016 222/183
(Continued)

FOREIGN PATENT DOCUMENTS

CN 201055827 Y * 5/2008 ..... B05B 11/0056
CN 202276969 U 6/2012
EP 2383204 A1 11/2011

*Primary Examiner* — Donnell Long
(74) *Attorney, Agent, or Firm* — William Dippert; Laurence Greenberg; Werner Stemer

(57) ABSTRACT

An encased dispenser (100, 100', 200, 300, 400) comprising a casing (102) and a dispenser (104, 104', 204, 304) is provided. The casing (102) comprises a cap (120, 120', 220, 320, 420) and a cover (140, 140', 240, 340, 440). The dispenser (104, 104', 204, 304) comprises a top part (107) and a bottom part (106). The top part (107) comprises a dispensing mechanism (135). The casing (102) and the bottom part (106) are engaged to each other, and the cap (120, 120', 220, 320, 420) and the top part (107) are engaged to each other. The engagement of the casing (102) to the bottom part (106) is stronger than the engagement of the cap
(Continued)

(120, 120', 220, 320, 420) to the top part (107), and the encased dispenser (100, 100', 200, 300, 400) excludes threading.

28 Claims, 7 Drawing Sheets

(51) Int. Cl.

| | |
|---|---|
| ***A45D 34/02*** | (2006.01) |
| ***A45D 34/04*** | (2006.01) |
| ***A45D 40/26*** | (2006.01) |
| *A45D 40/00* | (2006.01) |

(52) U.S. Cl.
CPC ..... *A45D 40/26* (2013.01); *A45D 2034/007* (2013.01); *A45D 2040/0012* (2013.01)

(58) Field of Classification Search
USPC ..... 222/183, 325–327; 206/457, 495.5; 220/4.21; 53/476
See application file for complete search history.

(56) References Cited

U.S. PATENT DOCUMENTS

| | | | | |
|---|---|---|---|---|
| 4,750,532 | A * | 6/1988 | Grothoff | B05B 9/0838 141/113 |
| 5,586,694 | A * | 12/1996 | Breidenbach | A45D 34/02 222/183 |
| 6,435,231 | B1 * | 8/2002 | Cooper | B65D 81/3211 141/107 |
| 6,857,806 | B2 * | 2/2005 | Harrison | A45D 34/041 401/208 |
| 8,695,896 | B2 * | 4/2014 | Tu | B05B 11/0056 141/113 |
| 8,978,938 | B2 | 3/2015 | Hui et al. | |

* cited by examiner

ENCASED DISPENSER

FIELD OF THE INVENTION

The present invention relates to dispensers. More particularly, the present invention relates to a case including a changeable cover and a changeable cap for a matching dispenser especially for cosmetic products such as perfumes, aftershaves, creams, etc.

BACKGROUND OF THE INVENTION

Some commercially available dispensers for perfumes, aftershave and similar products are covered with protective and/or decorative cases. Such parts typically include a protective/decorative cover on a bottom portion of the bottle, a fixed cover that cannot be changed, and a protective/decorative detachable covering cap, that may match the cover in style, and allows easy dispensation of the liquid—see for example http://www.amazon.com/Travalo-Travel-Refillable-Refills-Fragrance/dp/B002FQKKBQ.

In contrast to the cap on the top portion of the dispenser, the cover of the bottom portion does not need to be removed every time the dispenser is used. Nevertheless, there could be times at which it may be useful to remove the cover, for example to replace a worn-out or broken cap and/or cover with a matching case of a new cap and cover. In a further example, in refillable dispensers it may be useful to have the possibility to remove or substitute the cover since the refilling mechanism is not easily accessible when covered. A problem with such putative structures would be that the more frequent attempts to remove the cap for dispensing might instead remove the cover, which would be annoying and time consuming and not allow to properly use the dispenser.

U.S. Pat. No. 5,586,694 ("Perfume applicator with replaceable cartridges") describes a perfume dispenser with threaded covers which are screwed onto threads positioned at the dispenser. Such type of covers requires correct alignment of threads on the cover and on the dispenser in order to allow the screwing of the cover onto the dispenser which may take some time.

There is an unmet need for dispensers with both a changeable cover and a changeable cap that can be easily used according to the desire of the user that can allow for example to differentiate between products.

It should be noted that reference to the use of perfume as an example below doesn't limit the invention, and the current invention can be applied to any refillable liquid.

SUMMARY OF THE INVENTION

According to one aspect, an encased dispenser comprising a casing and a dispenser is provided, wherein:

the casing comprises a cap and a cover;

the dispenser comprises a top part and a bottom part;

the top part comprises a dispensing mechanism;

the casing and the bottom part are engaged to each other; and the cap and the top part are engaged to each other;

the encased dispenser characterized by:

engagement of the casing to the bottom part being stronger than engagement of the cap to the top part, and the encased dispenser excluding threading.

In some embodiments the dispenser further comprises a ledge positioned between the top part and the bottom part, wherein the ledge prevents operation of the dispensing mechanism when the cap is engaged with the top part.

In some embodiments the dispenser further comprises a refill mechanism in the bottom part, and the cover is configured to allow refilling the encased dispenser via the refill mechanism.

In some embodiments the cover comprises an aperture through which the dispenser is refillable.

In some embodiments, the dispenser further comprises a ledge positioned between the top part and the bottom part, and wherein the ledge prevents operation of the dispensing mechanism when the cap is engaged with the top part, and allows the refill mechanism to be essentially flush with the aperture.

In some embodiments the cover has at least one dispenser bottom protrusion; and the bottom part has thereon a lip;

wherein the bottom protrusion and the lip are situated relative to each other such that in order to pull apart the cover from the dispenser, the cover protrusions have to be forced over the lip.

In some embodiments the bottom part has at least one dispenser bottom protrusion; and the cover has therein a lip;

wherein the bottom protrusion and the lip are situated relative to each other such that in order to pull apart the cover from the dispenser, the dispenser bottom protrusions have to be forced over the lip.

In some embodiments when the cover is completely slid onto the dispenser bottom part, the protrusions are essentially flush with the lip.

In some embodiments the top part has at least one dispenser top protrusion; the encased dispenser configured to allow easily sliding the cap onto the dispenser to engage the protrusion with the cap.

In some embodiments the cap has at least one protrusion; the encased dispenser configured to allow easily sliding the cap onto the dispenser to engage the protrusion with the top part.

In some embodiments both cap and cover have a shape capable of providing stable placing of the encased dispenser standing up on a horizontal surface.

In some embodiments:

the dispenser further comprises a container fluidly connected to the refill mechanism and the dispensing mechanism;

the container comprises a gripping element with a plurality of knobs attached onto circumferential ridges of the container, and wherein a locking element having slots is capable of snapping onto the knobs.

In some embodiments the gripping element and locking element are engaged with the cover.

In some embodiments the cover further has a transparent window.

In some embodiments the cap is transparent.

In some embodiments the cover is transparent.

In some embodiments the cap and the cover are detachable.

In some embodiments the encased dispenser comprises a set of covers wherein each cover is provided with a different coloring.

In some embodiments the encased dispenser comprises a set of covers, wherein the each cover is provided with a different shape.

In some embodiments the encased dispenser comprises a set of covers, wherein each cover is provided with a different printed logo.

In some embodiments the encased dispenser comprises a set of caps, wherein each cap is provided with a different coloring.

Some embodiments comprise a set of caps, wherein the each cap is provided with a different shape.

In some embodiments the encased dispenser comprises a set of caps, wherein each cap is provided with a different printed logo.

According to another aspect, a method for attaching a cap to a dispenser having a top part with at least one dispenser top protrusion and a bottom part is provided, the method comprises the following steps:

providing a cap;

sliding the cap onto the dispenser top part; and engaging the cap and the at least one dispenser top protrusion of the top part;

wherein engaging the cap onto the dispenser excludes screwing.

In some embodiments, the method comprises the following steps:

providing an encased dispenser attached to a cap;

providing a replacement cap;

detaching the cap from the top part; and attaching the replacement cap onto the at least one dispenser top protrusion of the top part.

According to a further aspect, a method for attaching a cover to a dispenser having a top part and a bottom part with at least one dispenser bottom protrusion is provided, the method comprises the following steps:

providing a cover, having a lip;

sliding the cover onto the dispenser bottom part; and engaging the cover and the at least one dispenser bottom protrusion of the bottom part;

wherein engaging the cover onto the dispenser excludes screwing.

In some embodiments, the method comprises the following steps:

providing an encased dispenser attached to a cover;

providing a replacement cover;

detaching the cover from the bottom part; and attaching the replacement cover onto the at least one dispenser bottom protrusion of the bottom part.

According to a further aspect, a method for changing the appearance of a dispenser having a top part with at least one dispenser top protrusion and a bottom part with at least one dispenser bottom protrusion is provided, wherein the dispenser is encased in a cap and a cover, and wherein the method comprises the following steps:

providing an encased dispenser attached to a cap and to a cover;

providing a replacement cap and a replacement cover;

detaching the cap from the top part;

detaching the cover from the bottom part;

attaching the replacement cap onto the at least one dispenser top protrusion of the top part; and attaching the replacement cover onto the at least one dispenser bottom protrusion of the bottom part;

wherein the detaching of the cap requires less force than detaching of the cover.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

Figure 1B:
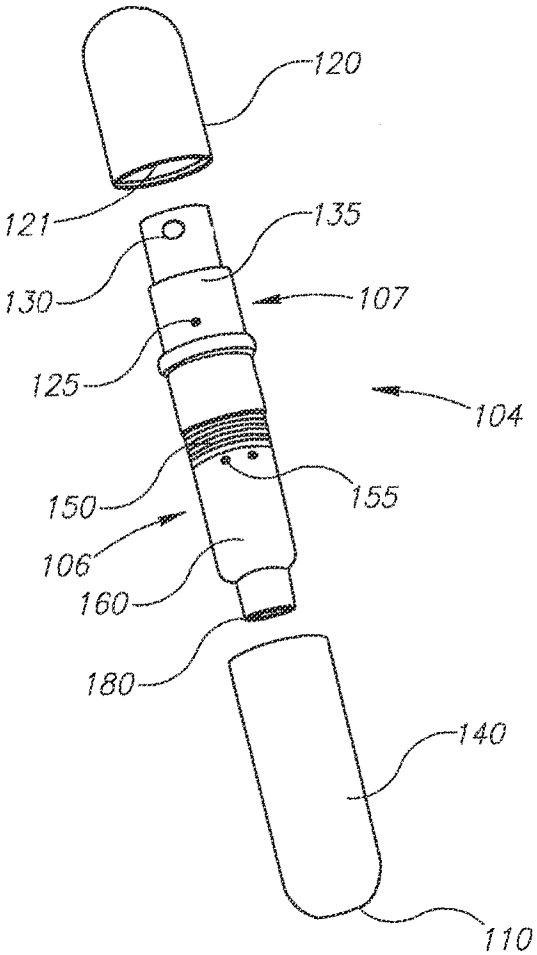
FIG. 1B illustrates an exploded perspective view of the encased dispenser, according to another exemplary embodiment.
Figure 1A:
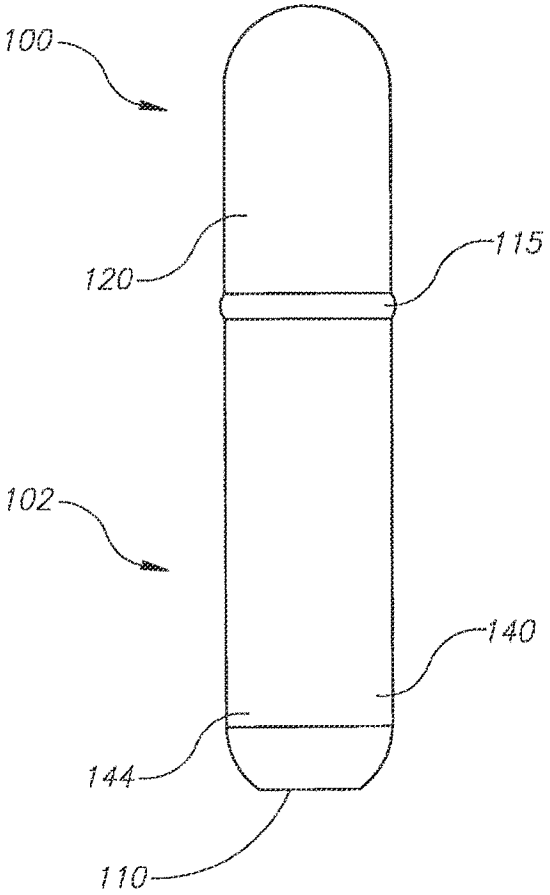
FIG. 1A illustrates a dispenser encased in a cap and a cover, according to an exemplary embodiment.
Figure 1C:
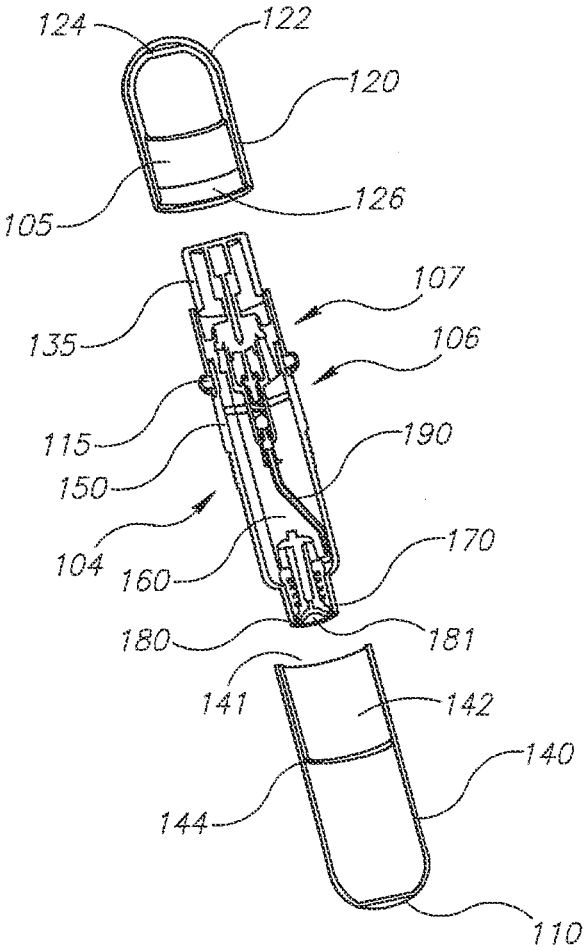
FIG. 1C illustrates an exploded cross-sectional view of the encased dispenser.
Figure 2:
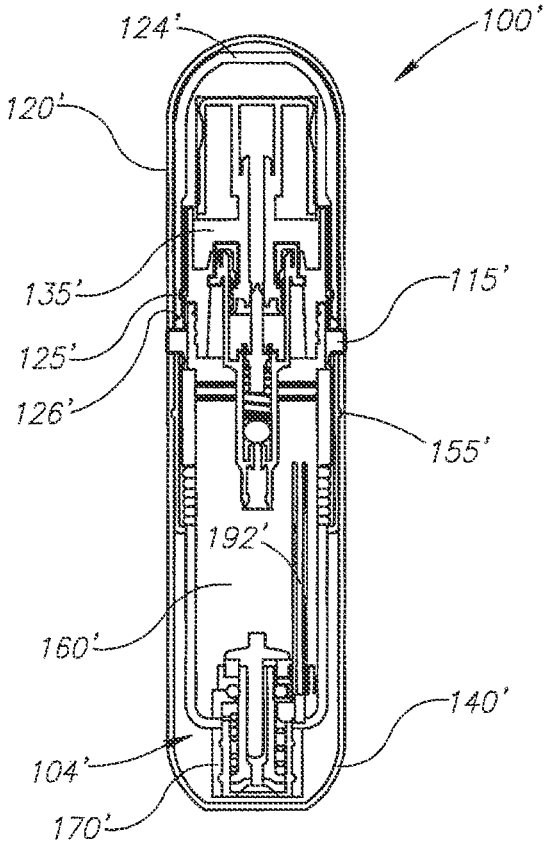
FIG. 2 shows another encased dispenser embodiment
Figures 3A, 3B:
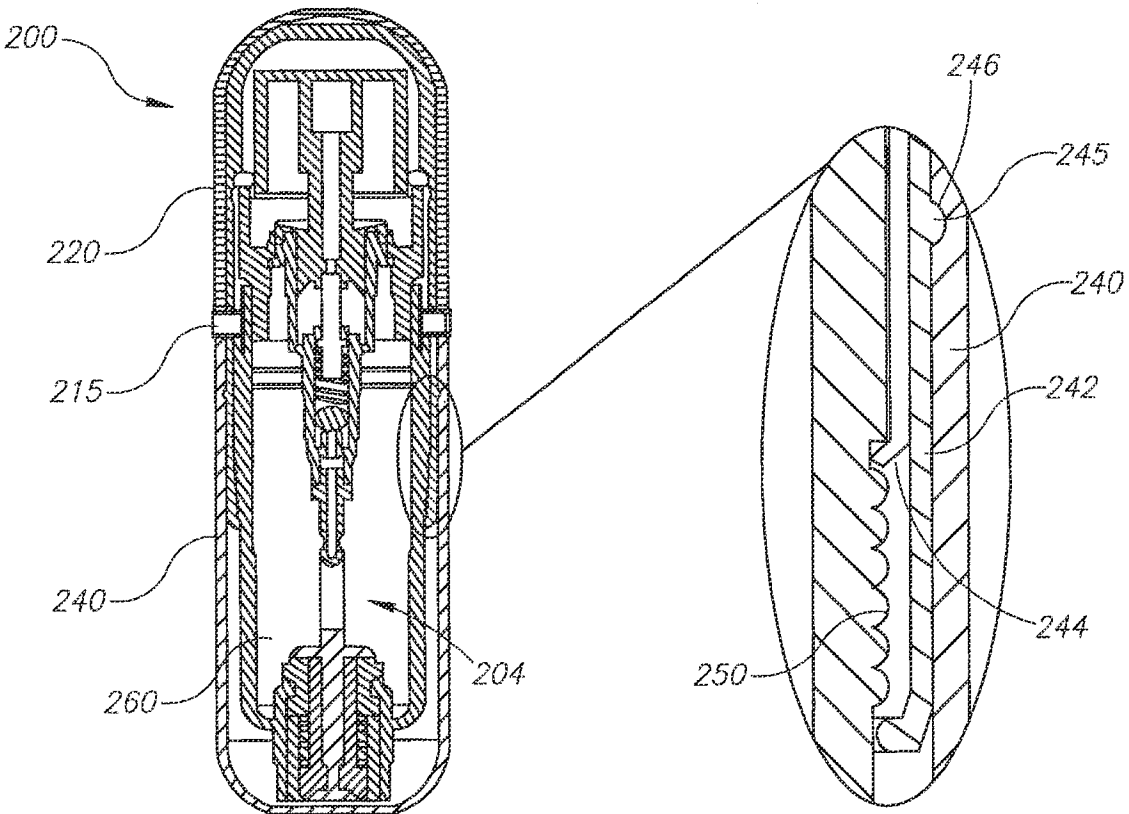
FIG. 3A illustrates a cross-sectional view of a dispenser with both cap and cover on, according to a further exemplary embodiment.
FIG. 3B shows an enlarged segment of a locking arrangement between the dispenser and the cover.
Figures 4A, 4B, 4C:
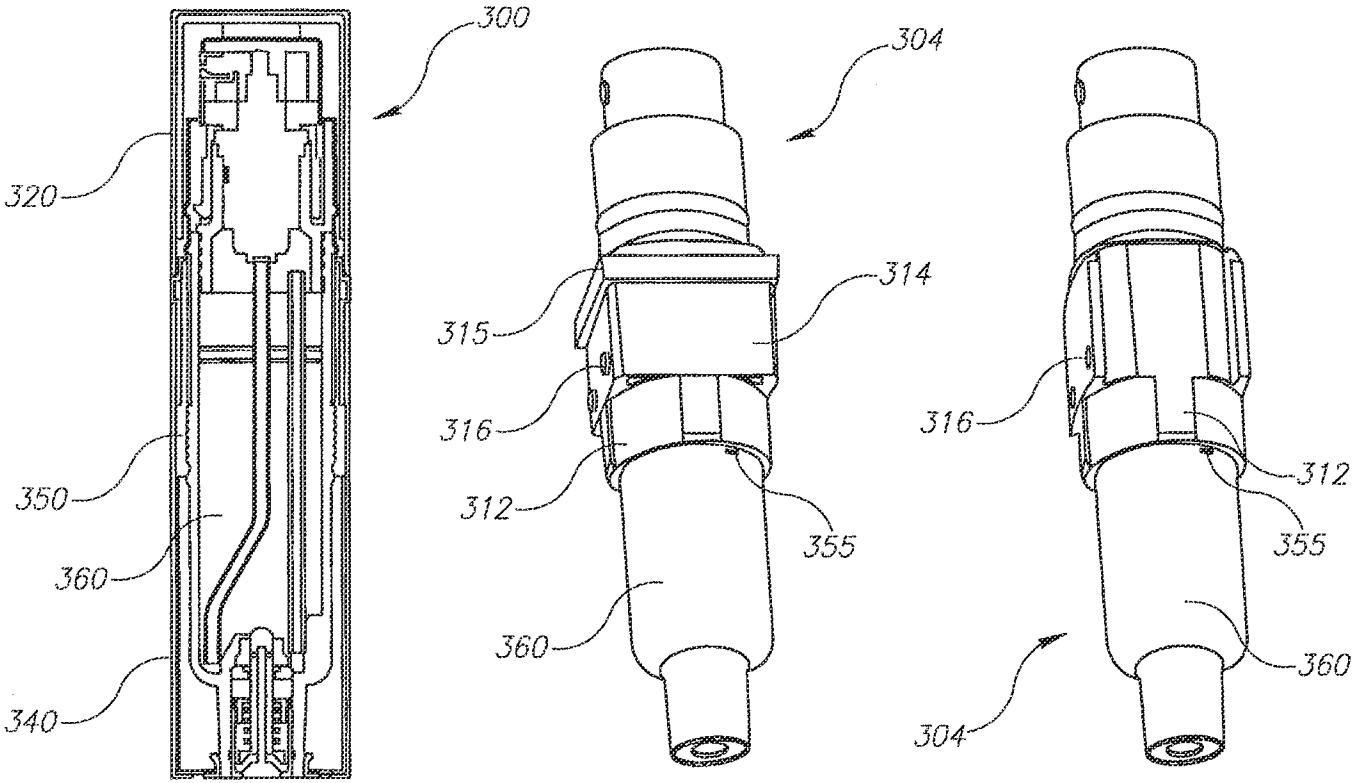
FIG. 4A illustrates a cross-sectional view of a dispenser with both a rectangular cap and a cover on, according to a further exemplary embodiment.
FIG. 4B illustrates a dispenser with both the rectangular cap and the cover removed, according to a further exemplary embodiment.
FIG. 4C illustrates a dispenser with the rectangular cap, the cover and a locking arrangement removed.
Figure 5B:
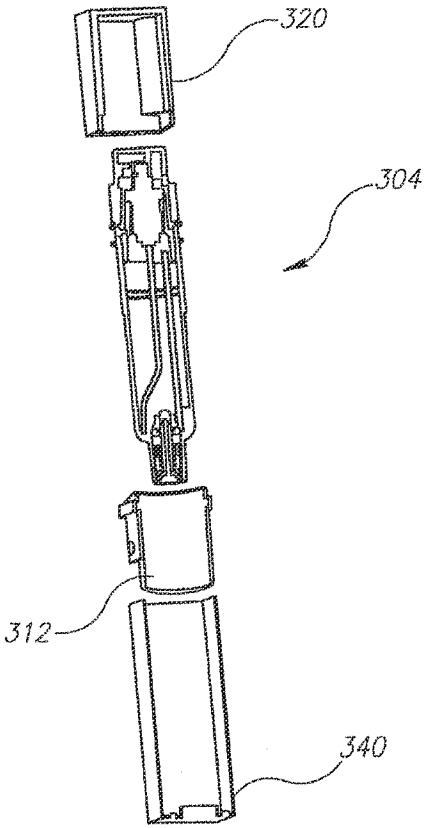
FIG. 5B illustrates a cross-sectional exploded view of the dispenser with the gripping element and the rectangular cap, cover and locking element removed.
Figure 5A:
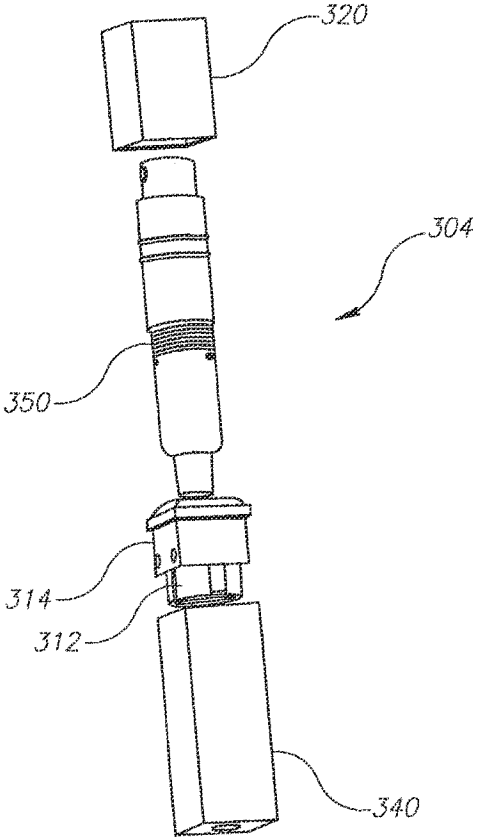
FIG. 5A illustrates an exploded view of the dispenser with a gripping element and the rectangular cap, the cover and the locking element removed, according to a further exemplary embodiment.
Figure 6:
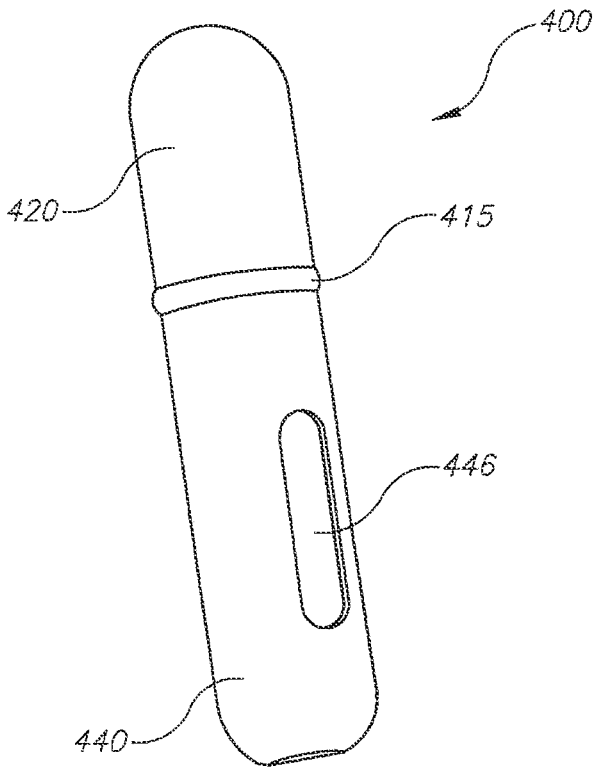
FIG. 6 illustrates the dispenser with both the cap and the cover on with an additional window at the cover, according to a further exemplary embodiment

The invention claimed is:

1. An encased dispenser comprising a casing and a dispenser, wherein:

the casing comprises a cap and a cover;

the dispenser comprises a top part and a bottom part;

the top part comprises a dispensing mechanism; and the casing and the bottom part are engaged to each other, and the cap and the top part are engaged to each other, wherein engagement of the casing to the bottom part is stronger than engagement of the cap to the top part, wherein the casing excludes threading, wherein the dispenser further comprises a refill mechanism in the bottom part, and the cover is configured to allow refilling the encased dispenser via the refill mechanism, wherein the cover has at least one dispenser bottom protrusion, and the bottom part has thereon a lip, and wherein the bottom protrusion and the lip are situated relative to each other such that in order to pull apart the cover from the dispenser, the at least one dispenser bottom protrusion has to be forced over the lip.

2. The encased dispenser of claim 1, wherein the dispenser further comprises a ledge positioned between the top part and the bottom part, wherein the ledge prevents operation of the dispensing mechanism when the cap is engaged with the top part.

3. The encased dispenser of claim 1, wherein the cover comprises an aperture through which the dispenser is refillable.

4. The encased dispenser of claim 3, wherein the dispenser further comprises a ledge positioned between the top part and the bottom part, and wherein the ledge prevents operation of the dispensing mechanism when the cap is engaged with the top part, and allows the refill mechanism to be essentially flush with the aperture.

5. The encased dispenser of claim 1, wherein when the cover is completely slid onto the dispenser bottom part, the protrusions are essentially flush with the lip.

6. The encased dispenser of claim 1, wherein:

the top part has at least one dispenser top protrusion, and the encased dispenser is configured to allow easily sliding the cap onto the dispenser to engage the protrusion with the cap.

7. The encased dispenser of claim 1, wherein:

the cap has at least one protrusion, and the encased dispenser is configured to allow easily sliding the cap onto the dispenser to engage the protrusion with the top part.

8. The encased dispenser of claim 1, wherein both cap and cover have a shape capable of providing stable placing of the encased dispenser standing up on a horizontal surface.

9. The encased dispenser of claim 1, comprising a set of covers, wherein the cap and the covers are detachable, and wherein each cover is provided with a different shape.

10. The encased dispenser of claim 1, comprising a set of covers, wherein the cap and the covers are detachable, and wherein each cover is provided with a different printed logo.

11. The encased dispenser of claim 1, comprising a set of caps, wherein the caps and the cover are detachable, and wherein each cap is provided with a different coloring.

12. The encased dispenser of claim 1, comprising a set of caps, wherein the caps and the cover are detachable, and wherein the each cap is provided with a different shape.

13. The encased dispenser of claim 1, comprising a set of caps, wherein the caps and the cover are detachable, and wherein each cap is provided with a different printed logo.

14. An encased dispenser comprising a casing and a dispenser, wherein:

the casing that exclude threading comprises a cap and a cover;

the dispenser comprises a top part and a bottom part;

the top part comprises a dispensing mechanism; and the casing and the bottom part are engaged to each other, and the cap and the top part are engaged to each other, wherein engagement of the casing to the bottom part is stronger than engagement of the cap to the top part, wherein the dispenser further comprises a refill mechanism in the bottom part, and the cover is configured to allow refilling the encased dispenser via the refill mechanism, wherein the bottom part has at least one dispenser bottom protrusion, and the cover has therein a lip, and wherein the dispenser bottom protrusion and the lip are situated relative to each other such that in order to pull apart the cover from the dispenser, the at least one dispenser bottom protrusions has to be forced over the lip.

15. The encased dispenser of claim 14, wherein when the cover is completely slid onto the dispenser bottom part, the protrusions are essentially flush with the lip.

16. The encased dispenser of claim 14, wherein the dispenser further comprises a ledge positioned between the top part and the bottom part, wherein the ledge prevents operation of the dispensing mechanism when the cap is engaged with the top part.

17. The encased dispenser of claim 14, wherein the cover comprises an aperture through which the dispenser is refillable.

18. The encased dispenser of claim 14, wherein the dispenser further comprises a ledge positioned between the top part and the bottom part, and wherein the ledge prevents operation of the dispensing mechanism when the cap is engaged with the top part, and allows the refill mechanism to be essentially flush with the aperture.

19. The encased dispenser of claim 14, wherein:

the top part has at least one dispenser top protrusion, and the encased dispenser is configured to allow easily sliding the cap onto the dispenser to engage the protrusion with the cap.

20. The encased dispenser of claim 14, wherein:

the cap has at least one protrusion, and the encased dispenser is configured to allow easily sliding the cap onto the dispenser to engage the protrusion with the top part.

21. The encased dispenser of claim 14, wherein both cap and cover have a shape capable of providing stable placing of the encased dispenser standing up on a horizontal surface.

22. The encased dispenser of claim 14, comprising a set of covers, wherein the cap and the covers are detachable, and wherein each cover is provided with a different shape.

23. The encased dispenser of claim 14, comprising a set of covers, wherein the cap and the covers are detachable, and wherein each cover is provided with a different printed logo.

24. The encased dispenser of claim 14, comprising a set of caps, wherein the caps and the cover are detachable, and wherein each cap is provided with a different coloring.

25. The encased dispenser of claim 14, comprising a set of caps, wherein the caps and the cover are detachable, and wherein the each cap is provided with a different shape.

26. The encased dispenser of claim 14, comprising a set of caps, wherein the caps and the cover are detachable, and wherein each cap is provided with a different printed logo.

27. An encased dispenser comprising a casing and a dispenser, wherein:

the casing that exclude threading comprises a cap and a cover;

the dispenser comprises a top part and a bottom part;

the top part comprises a dispensing mechanism; and the casing and the bottom part are engaged to each other, and the cap and the top part are engaged to each other, wherein engagement of the casing to the bottom part is stronger than engagement of the cap to the top part, wherein the dispenser further comprises a refill mechanism in the bottom part, and the cover is configured to allow refilling the encased dispenser via the refill mechanism, wherein the dispenser further comprises a container fluidly connected to the refill mechanism and the dispensing mechanism, and wherein the container comprises a gripping element with a plurality of knobs attached onto circumferential ridges of the container, and wherein a locking element having slots is capable of snapping onto the knobs.

28. The encased dispenser of claim 27, wherein the gripping element and locking element are engaged with the cover.

* * * * *